US006966641B2

(12) United States Patent
Taniguchi et al.

(10) Patent No.: US 6,966,641 B2
(45) Date of Patent: Nov. 22, 2005

(54) INK RESERVOIR, INK JET HEAD STRUCTURE INCLUDING INK RESERVOIR, AND INK JET RECORDING APPARATUS INCLUDING INK RESERVOIR

(75) Inventors: Suguru Taniguchi, Tokyo (JP); Toshihiko Ujita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 10/705,268

(22) Filed: Nov. 10, 2003

(65) Prior Publication Data

US 2004/0100538 A1 May 27, 2004

(30) Foreign Application Priority Data

Nov. 20, 2002 (JP) ..... 2002-336460

(51) Int. Cl.[7] ..... B41J 2/175

(52) U.S. Cl. ..... 347/86

(58) Field of Search ..... 347/86, 89, 87, 347/85, 94, 92, 29, 6

(56) References Cited

U.S. PATENT DOCUMENTS

| | | | | |
|---|---|---|---|---|
| 4,433,341 | A * | 2/1984 | Thomas | 347/6 |
| 4,680,696 | A * | 7/1987 | Ebinuma et al. | 347/85 |
| 5,159,348 | A * | 10/1992 | Dietl et al. | 347/89 |
| 5,936,650 | A * | 8/1999 | Ouchida et al. | 347/89 |
| 6,293,665 | B1 * | 9/2001 | Pew et al. | 347/87 |

FOREIGN PATENT DOCUMENTS

| | | |
|---|---|---|
| JP | 8-112913 | 5/1996 |

* cited by examiner

*Primary Examiner*—K. Feggins
(74) *Attorney, Agent, or Firm*—Morgan & Finnegan, LLP

(57) ABSTRACT

In a sub-tank of an ink jet recording head, an ink absorbing member capable of being impregnated with and holding an ink is arranged and a space V2, which is an area formed by a first wall surface of an ink reservoir and the ink absorbing member and in which the ink absorbing member is not present, is formed. A gas-liquid separation member made of a porous member, transmitting a gas but shutting off a liquid such as the ink is provided in a cap member in which an air hole is formed. A volume of the space V2 and a total volume V2 of an amount of the ink by which the ink is discharged from a discharge port of an ink jet recording element in one recovery operation and an initial pre-discharge amount hold a relationship of $0.7V1 \leqq V2 \leqq V1$.

5 Claims, 14 Drawing Sheets

INK FILLING
(FIRST TIME)
INK REFILLING
INK REFILLING
ABSORBING MEMBER
REMAINING INK
USABLE INK
ABSORBING MEMBER
AIR ACCUMULATION
REMAINING INK
USABLE INK
ABSORBING MEMBER
AIR ACCUMULATION
REMAINING INK
USABLE INK
INK FILLING AMOUNT

FIG. 16

| RELATION OF V1, V2, V3 | | V1(cc) | V2(cc) | V3(cc) | INK USABLE AMOUNT (cc) AFTER 2000 TIMES | IMPROVEMENT RATE (%) OF INK USABLE AMOUNT RELATIVE TO V2=0 |
|---|---|---|---|---|---|---|
| V3=6V1 | V2/V1=0 | 0.021 | 0 | 0.12 | 0.05 | 0 |
| | V2/V1=0.5 | 0.021 | 0.0105 | 0.12 | 0.058 | 16 |
| | V2/V1=0.7 | 0.021 | 0.0147 | 0.12 | 0.078 | 56 |
| | V2/V1=1 | 0.021 | 0.021 | 0.12 | 0.085 | 70 |
| V3=20V1 | V2/V1=0 | 0.021 | 0 | 0.42 | 0.208 | 0 |
| | V2/V1=0.5 | 0.021 | 0.0105 | 0.42 | 0.226 | 9 |
| | V/V12=0.7 | 0.021 | 0.0147 | 0.42 | 0.301 | 45 |
| | V2/V1=1 | 0.021 | 0.021 | 0.42 | 0.319 | 53 |
| V3=25V1 | V2/V1=0 | 0.021 | 0 | 0.525 | 0.22 | 0 |
| | V2/V1=0.5 | 0.021 | 0.0105 | 0.525 | 0.229 | 4 |
| | V2/V1=0.7 | 0.021 | 0.0147 | 0.525 | 0.234 | 6 |
| | V2/V1=1 | 0.021 | 0.021 | 0.525 | 0.238 | 8 |

INK RESERVOIR, INK JET HEAD STRUCTURE INCLUDING INK RESERVOIR, AND INK JET RECORDING APPARATUS INCLUDING INK RESERVOIR

BACKGROUND OF THE INVENTION

1. Field of the Invention

The present invention relates to an ink reservoir which stores an ink supplied to a recording head employed in an ink jet recording field, an ink jet head structure including the ink reservoir, and an ink jet recording apparatus including the ink reservoir. More specifically, the present invention relates to an ink jet head structure including an ink reservoir which structure adopts an intermittent ink supply system mounted on a carriage of the ink jet recording apparatus with an ink jet recording head, connected to a main ink tank at need and intermittently supplied with an ink and to an ink jet recording apparatus including the ink reservoir.

2. Related Background Art

As an ink jet recording apparatus that records data while scanning an ink jet recording head, there is known a so-called on-carriage type ink jet recording apparatus where an ink jet recording head 201 having a nozzle which discharges an ink is connected to an ink tank which stores and holds the ink supplied to the head 201 and which has an air communication section having an interior opened to the air, the resultant connected head and tank are mounted on a carriage 201*a* in a cartridge state in which a head cartridge 201*b* is detachably attachable to the carriage (in which state the recording head and the ink tank can be provided either integrally or separably), and the carriage 201*a* allows the head cartridge 201*b* to perform scanning and recording along a guide shaft 208 as shown in FIG. 11.

As shown in FIG. 12, there is also known a so-called tube supply type ink jet recording apparatus where only an ink jet recording head 301 is provided on a carriage 301*a*, a tank cartridge 301*c* which stores an ink is provided on a main body side, and the ink is supplied to the ink jet recording head 301 by connecting the head 301 to the tank cartridge 301*c* by a flexible ink supply tube 301*d*.

However, the on-carriage type apparatus as shown in FIG. 11 has the following disadvantages. Since the head cartridge 201*b* which holds the ink therein is provided on the carriage 201*a*, the weight of the apparatus is disadvantageously heavy and the heavy weight hampers high rate scanning of the cartridge 201*a*. In addition, if the head cartridge. 201*b* is made small in size so as to reduce the weight of the apparatus, the number of sheets on which data can be recorded disadvantageously decreases.

The tube supply type apparatus as shown in FIG. 12 has the following disadvantages. A mechanism of the apparatus is disadvantageously complicated since the ink cartridge 301*c* provided on the main body side is connected to the ink jet recording head 301 by the ink supply tube 301*d*, with the result that it is disadvantageously difficult to make the apparatus small in size.

To overcome these disadvantages, there is proposed an intermittent ink supply type (which will be often referred to as "pit-in type" for the sake of convenience) apparatus where a recording head having a sub-tank is provided on a carriage, the recording head is connected to a main tank provided on an apparatus main body at need when the carriage is at a home position or a predetermined position to thereby supply a predetermined amount of ink to the sub-tank on the carriage.

FIG. 13 is a schematic diagram which illustrates one example of the pit-in type ink jet recording apparatus (see Japanese Patent Application Laid-Open No. H8-112913).

As shown in FIG. 13, a recording head 401 that records data on a recording sheet 420 carried by a paper feed roller 421 is mounted on a carriage 401*a*. This carriage 401*a* is constituted to be guided by a guide shaft 408. A main tank 404 which replenishes a sub-tank 403 of the recording head 401 with an ink is arranged at a home position 423. This main tank 404 is provided with a supply tube 410 connected with an ink supply port 411 of the sub-tank 403. A dummy cap 406 which seals and protects an ink jet recording element, an absorbing cap 405 which absorbs the ink from a nozzle of the ink jet recording element, and an air intake cap 422 which absorbs air from an air hole 415 of the sub-tank 403 are provided to communicate with a negative pressure generator 407.

A pit-in operation of the pit-in type ink jet recording apparatus shown in FIG. 13 will next be described.

When the apparatus records no data, the ink jet recording head 401 waits at the home position 423 at which the head 401 is connectable to the absorbing cap 405, the air intake cap 422, the dummy cap 406, and the main tank 404. If a recording signal is transmitted to a recording apparatus main body, the dummy cap 406 seals a discharge port, not shown, of the ink jet recording element, and the supply tube 410 of the main tank 404 is connected to an ink supply port 411 of the sub-tank 403. The air intake cap 422 is then connected to the air hole 415 of the sub-tank 403 and the negative pressure generator 407 is actuated. The negative pressure generator 407 reduces an internal pressure of the sub-tank 403, whereby the ink is supplied from the main tank 404 to the sub-tank 403.

Next, a recovery operation is performed so as to prevent a backward flow of the ink in the nozzle toward the sub-tank 403 which flow occurs when the internal pressure of the sub-tank 403 is reduced or prevent poor discharge caused by clogging of the ink which viscosity is improved after the ink is left as it is for a long time. In this recovery operation, the air hole 415 and the ink supply port 411 of the sub-tank 403 are let open, the absorbing cap 405 is connected to the ink jet recording element, and the ink in the nozzle is absorbed by the negative pressure generator 407. After absorbing the ink, the ink adhering to a discharge port surface of the ink jet recording head 401 is wiped away (subjected to wiping), a pre-discharge for removing a mixed color ink forced into the nozzle by the wiping is performed, and then recording is started.

As can be seen, according to the pit-in type ink jet recording apparatus, since only the ink jet recording element and the sub-tank 403 are arranged on the carriage 401, the weight of the carriage 401 can be reduced. Therefore, the ink jet recording head 401 can be scanned at high rate. In addition, since the sub-tank 403 is replenished with the ink by the main tank 404 at the home position 423, the number of recording sheets can be increased. Further, since there is no need to connect carriage to the tank by the ink supply tube as required in the tube-supply type apparatus that employs the tank cartridge, the configuration of the apparatus can be advantageously made quite simple.

As an ink replenishment mechanism for replenishing the ink from the main tank to the sub-tank in this pit-in type ink jet recording apparatus, there is known a mechanism in which a sensor detects an ink amount by which the ink can be supplied to the sub-tan during the pit-in operation to thereby supply the ink to the sub-tank (see, for example, Japanese Patent Application Laid-Open No. H8-112913).

However, this mechanism is often quite complicated, delicate and expensive.

To solve these disadvantages, there is proposed a pit-in type ink jet recording apparatus having a gas-liquid separation member is arranged in the sub-tank. FIG. 14 is a schematic cross-sectional view illustrating one example of an ink jet recording head employed in the pit-in type ink jet recording apparatus that employs the gas-liquid separation member.

This ink jet recording head shown therein is mounted on the ink jet recording apparatus as shown in FIG. 13. An ink absorbing member 437 is arranged in an ink reservoir 436 which stores an ink. The gas-liquid separation member 433 is arranged halfway along a cap member 435 communicating with the air port 415. The gas-liquid separation member 433 is a porous member made of PTFE (polytetrafluoroethylene) or the like that transmits a gas but shuts off a liquid such as an ink.

An ink replenishment operation for replenishing the pit-in type ink jet recording head shown in FIG. 14 with the ink will next be described.

If a recording signal is transmitted to the recording apparatus main body, the dummy cap 406 seals the discharge port of the ink jet recording element 438 and the supply tube 410 of the main tank 404 is connected to the ink supply port 411 of the sub-tank 403. The absorbing cap 405 is connected to the air hole 415 of the sub-tank 403, and the negative pressure generator 407 is actuated to discharge the air in the ink reservoir 436 from the air hole 415 via the gas-liquid separation member 433. Accordingly, the internal pressure of the sub-tank 403 is reduced and the ink is continuously supplied to the sub-tank 403 from the main tank 404 through the supply tube 410 and the ink supply port 411 until the ink reservoir is filled with the ink. Right after the supply of the ink, the recovery operation, the wiping operation, and the initial pre-discharge operation are carried out as described with reference to FIG. 13, thereby turning a recording material into a state in which recording signals can be recorded on the recording material.

If the intake air amount of the negative pressure generator 407 is equal to or larger than an internal volume of the sub-tank 403, the air in the ink reservoir 436 is discharged through the gas-liquid separation member 433 and a new ink is fully replenished to the sub-tank 403 whatever the amount of the ink remaining in the ink reservoir 436 is. In this way, it suffices to absorb the air by a fixed amount or more so as to fully inject the ink. Therefore, it is unnecessary to conduct air discharge control. Besides, if the negative pressure generator is designed with a sufficient margin, it is basically possible to easily perform the ink replenishment operation.

As described above, according to the pit-in type ink jet recording apparatus that employs the gas-liquid separation member, the ink replenishment operation can be easily, stably performed. Further, by replenishing the ink whenever data is recorded on one sheet, it suffices that a usable ink amount held in the sub-tank is a sum of a necessary ink amount used for recording data on one recording sheet, the ink amount used for the recovery operation, and the ink amount used for the pre-discharge operation and that the ink reservoir is designed to be able to inject the total ink amount. Therefore, as compared with the conventional on-carriage type employing the head cartridge, it is possible to make the ink jet recording head small in size.

As described above, according to the pit-in type ink jet recording apparatus that employs the gas-liquid separation member, the head and the apparatus can be made small in size as compared with the conventional ink jet recording apparatuses.

Nevertheless, in order to further make the ink jet recording apparatus small in size, it is desired to further make the ink jet recording head, i.e., the sub-tank small in size.

To make the sub-tank small in size, it is considered to reduce the ink amount by which the ink is filled into the sub-tank. However, the ink amount necessary for recording data on the same recording material and those necessary for the recovery operation for preventing the poor discharge and the pre-discharge operation are constant irrespective of the type of the apparatus. Due to this, it is difficult to reduce the total ink amount. To make the sub-tank small in size, there is also proposed a method including improving an ink utilization efficiency of the ink filled into the sub-tank as high as possible and reducing the volume of the sub-tank.

Meanwhile, in the conventional ink jet recording head shown in FIG. 14, the porous ink absorbing member 437 is arranged in the ink reservoir almost entirely. By keeping the pressure of the ink acting on the discharge port negative using a capillary force of the porous member, it is advantageously possible to satisfactorily control the amount of the ink discharged from the ink jet recording head during recording and prevent the leakage of the ink from the discharge port while leaving the ink as it is. On the other hand, the conventional pit-in type ink jet recording apparatus has the following disadvantages. Since the ink absorbing member 437 is arranged in the ink reservoir, an ink filling amount is reduced by as much as a volume of the ink absorbing member and the ink remains in the ink absorbing member without being used after recording. As a result, the ink utilization efficiency is disadvantageously deteriorated (see FIG. 15A).

Further, the pit-in type ink jet recording apparatus which repeatedly performs recording and refilling has the following disadvantages. The apparatus generates an air accumulation in the ink absorbing member when the ink is refilled into the sub-tank. If the recording and refilling are repeated, the ink filling amount is reduced (see FIGS. 15B and 15C).

If the ink absorbing member is not arranged in the ink reservoir so as to solve these disadvantages, it is necessary to separately provide a mechanism that generates a negative pressure in the ink reservoir. The mechanism disadvantageously pushes up cost depending on a structure thereof and the sub-tank is disadvantageously made large in size.

SUMMARY OF THE INVENTION

It is, therefore, an object of the present invention to provide an ink reservoir which can ensure a large ink filling amount and a high ink utilization efficiency when an ink is initially filled and even when the ink is repeatedly refilled, which is small in size, and which can be manufactured at a low cost, a recording head structure which includes the ink reservoir, and an ink jet recording apparatus which includes the ink reservoir.

In order to achieve the above object, according to a first aspect of the present invention, there is provided an ink reservoir of an ink jet recording apparatus, the ink jet recording apparatus comprising: an ink jet head; the ink reservoir attached to the head and containing an ink absorbing member which stores an ink supplied to the head; pressure reduction means, connected to the ink reservoir at a specific timing, for reducing an internal pressure of the reservoir; and an ink tank containing the ink replenished into the ink reservoir by a pressure reduced state caused by the pressure reduction means connected to the ink reservoir at the specific timing, the ink jet recording apparatus discharging the ink from the ink jet head by a specified amount and performing an ink filling operation after the ink is replenished into the ink reservoir using the pressure reduction means and the ink tank, the ink reservoir comprising: an absorbing member arrangement area in which the ink absorbing member is arranged; and an absorbing member non-arrangement area that is a space in which the ink absorbing member is not arranged and that temporarily stores the ink, wherein if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of $V3 \leqq 20V1$ and $0.7V1 \leqq V2 \leqq V1$.

According to a second aspect of the present invention, there is provided an ink jet head structure comprising an ink reservoir of an ink jet recording apparatus, the ink jet recording apparatus comprising: an ink jet head; the ink reservoir attached to the head and containing an ink absorbing member which stores an ink supplied to the head; pressure reduction means, connected to the ink reservoir at a specific timing, for reducing an internal pressure of the reservoir; and an ink tank containing the ink replenished into the ink reservoir by a pressure reduced state caused by the pressure reduction means connected to the ink reservoir at the specific timing, the ink jet recording apparatus discharging the ink from the ink jet head by a specified amount and performing an ink filling operation after the ink is replenished into the ink reservoir using the pressure reduction means and the ink tank, the ink jet head structure comprising: an absorbing member arrangement area in which the ink absorbing member of the ink reservoir is arranged; and an absorbing member non-arrangement area that is a space in which the ink absorbing member is not arranged and that temporarily stores the ink, wherein if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of $V3 \leqq 20V1$ and $0.7V1 \leqq V2 \leqq V1$.

According to a third aspect of the present invention, there is provided an ink jet recording apparatus comprising: a main tank storing an ink; a negative pressure generator generating a negative pressure; and an ink jet recording head having an ink discharge port for discharging the ink, the ink jet recording head comprising a sub-tank storing the ink supplied from the main tank, wherein the sub-tank contains therein an ink absorbing member impregnated with and holding the ink, and comprises: a gas-liquid separation member arranged in the sub-tank, and separating the ink stored in the sub-tank from external air; an air hole for discharging air in the sub-tank through the gas-liquid separation member; an ink filled section replenished with the ink, the negative pressure generator is connected to the air hole and discharges the air in the sub-tank, whereby the ink is supplied from the main tank into the sub-tank through the ink filled section and the ink is discharged from the ink discharge port by a specified amount right after the ink is supplied, an area in the sub-tank which stores the ink right after the ink is supplied includes an absorbing member arrangement area in which the ink absorbing member is arranged and an absorbing member non-arrangement area that is a space in which the ink absorbing member is not arranged and which temporarily stores the ink, and in that if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of $V3 \leqq 20V1$ and $0.7V1 \leqq V2 \leqq V1$.

As described above, the ink reservoir, the ink jet head structure, and the ink jet recording head according to the present invention are each constituted so that the area in the sub-tank which stores the ink includes the absorbing member arrangement area in which the ink absorbing member is arranged and the absorbing member non-arrangement area in which the ink absorbing member is not arranged. That is, the ratio of the ink absorbing member in the area which stores the ink according to the present invention is lower than that of the ink absorbing member which entirely occupies the area which stores the ink. Therefore, it is possible to reduce the amount of the ink remaining in the ink absorbing member without being used by as much as the reduced amount of the ink absorbing member. It is also possible to reduce the air accumulation in the ink absorbing member which is generated during ink refilling by reducing the amount of the ink absorbing member. Therefore, the ink filling amount in the sub-tank can be increased. Thus, the ink jet recording head according to the present invention can increase the usable ink amount.

Furthermore, the ink reservoir, the ink jet head structure, and the ink jet recording head according to the present invention are each constituted so that the area in the sub-tank which stores the ink right after the ink is supplied includes an absorbing member arrangement area in which the ink absorbing member is arranged and an absorbing member non-arrangement area that is a space in which the ink absorbing member is not arranged and which temporarily stores the ink, and so that if the ink discharge amount that is the specified amount by which the ink is discharged is V1, the volume of the absorbing member non-arrangement area is V2, and the volume of the area in the sub-tank which stores the ink right after the ink is supplied is V3, then the volumes V1, V2, and V3 are set to satisfy $V3 \leqq 20V1$ and $0.7V1 \leqq V2 \leqq V1$. By providing the absorbing member non-arrangement space having the ink amount equal to that by which the ink is discharged in the ink discharge operation right after the supply of the ink, the ink which is not impregnated into and held by the ink absorbing member or so-called raw ink is promptly discharged in the ink discharge operation right after ink filling. Therefore, it is possible to maintain an appropriate negative pressure against the ink discharge port at need and prevent poor discharge during recording and the leakage of the ink from the ink discharge port while recording is not performed.

BRIEF DESCRIPTION OF THE DRAWINGS

FIG. 16 illustrates respective parameters as well as ink usable amounts after performing ink refilling 2,000 times and improvement rates of the ink usable amounts for the respective parameters relative to V2=0.

DETAILED DESCRIPTION OF THE PREFERRED EMBODIMENTS

Embodiments of the present invention will be described hereinafter with reference to the drawings.

(Embodiment 1)

Figure 1:
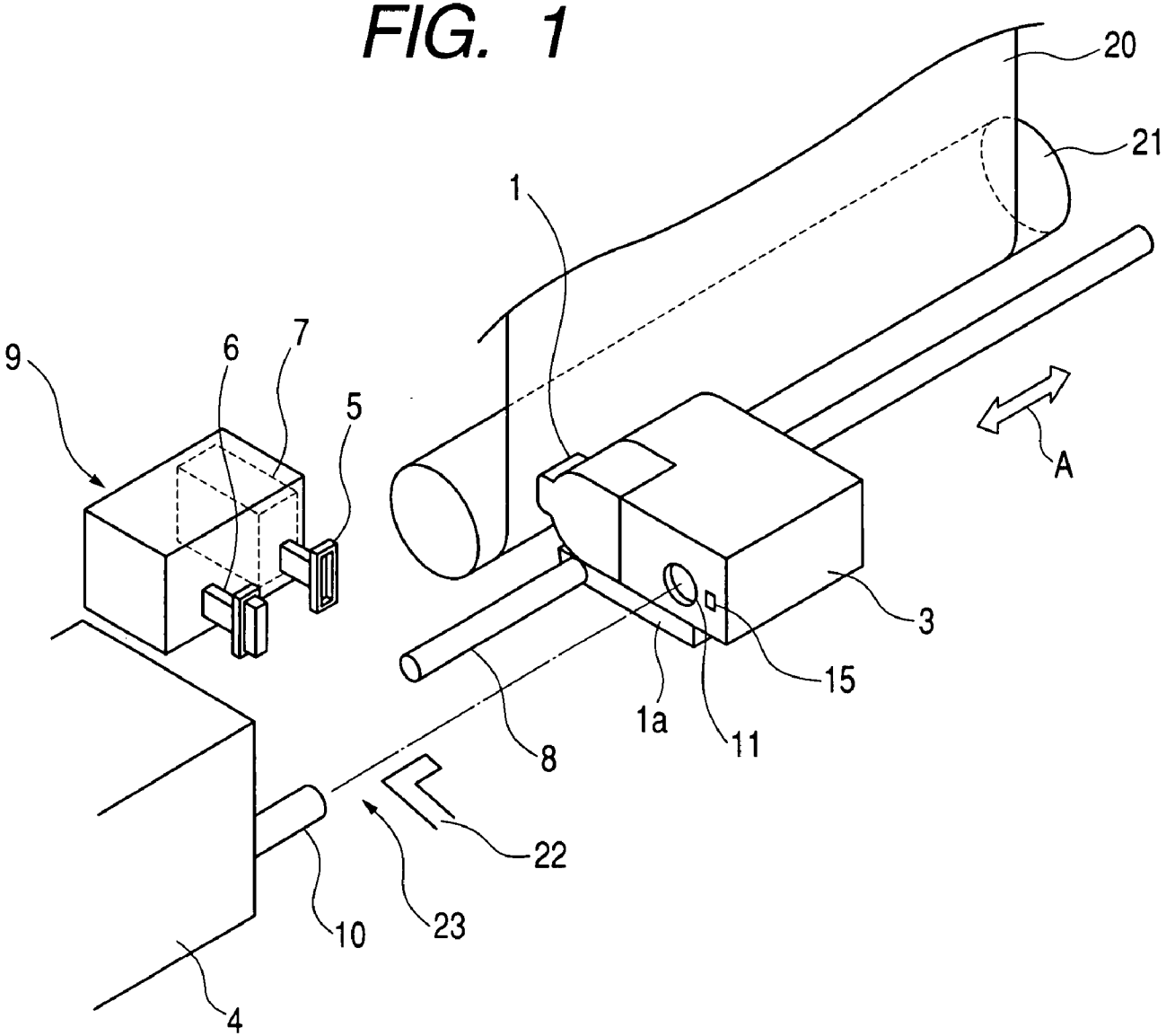
FIG. 1 is a partial schematic perspective view of a pit-in type ink jet recording apparatus according to the present invention.
Figure 2:
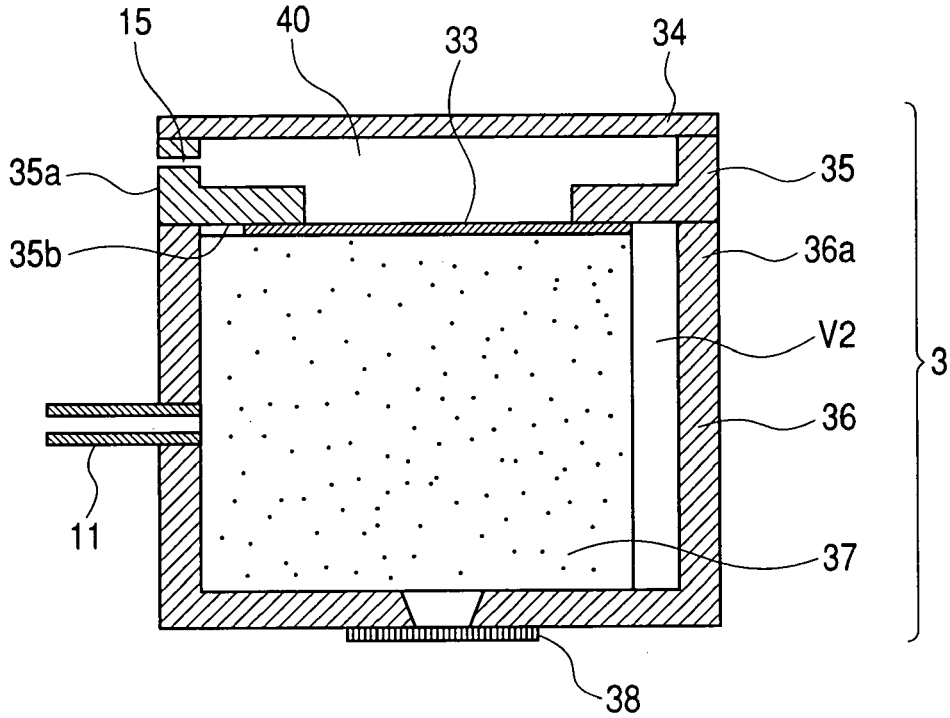
FIG. 2 is a side cross-sectional view of an ink jet recording head employing a gas-liquid separation member in Embodiment 1 according to the present invention.

FIG. 1 is a partial schematic perspective view of a pit-in type ink jet recording apparatus in Embodiment 1 according to the present application. FIG. 2 is a side cross-sectional view of an ink jet recording head mounted in the ink jet recording apparatus shown in FIG. 1 and employing a gas-liquid separation member.

The ink jet recording apparatus in Embodiment 1 includes a carriage 1*a* mounting thereon an ink jet recording head 1 which discharges an ink to a recording sheet 20 carried by a paper feed roller 21 and which records data on the recording sheet 20, a main tank 4 storing an ink replenished into a sub-tank 3 of the ink jet recording head 1, and a recovery mechanism 9 which recovers an ink discharge characteristic of the ink jet recording head 1.

The carriage 1*a* mounting thereon the ink jet recording head 1 is guided by a guide shaft 8 and scanned forward and backward in an arrow A direction.

The main tank 4 is arranged at a home position 23 and provided with a supply tube 10 connected to an ink supply port 11 of the sub-tank 3.

The recovery mechanism 9 includes a dummy cap 6 which seals and protects an ink jet recording element 38 and a negative pressure generator 7 which absorbs an ink from a nozzle of the ink jet recording element 38 and which absorbs the air from an air hole 15 of the sub-tank 3. To this negative pressure generator 7, an absorbing cap 5 which is abutted on the ink jet recording element 38 and which absorbs the ink from the nozzle of the ink jet recording element 38 and an air intake cap 22 which is abutted on the air hole 15 provided in the sub-tank 3 and absorbs the air in the sub-tank 3.

The ink jet recording head 1 includes the sub-tank 3 which contains therein an ink absorbing member 37 that absorbs and stores ink, a cap member 35 and a cover member 34 that constitute an upper surface of the sub-tank 3, and the ink jet recording element 38 which is provided on a lower surface of the sub-tank 3, which discharges the ink supplied from the sub-tank 3, and which records data on the recording sheet 20.

The ink jet recording element 38 discharging the ink to the recording sheet 20 and recording data on the recording sheet 20 basically consists of a common liquid chamber, not shown, a plurality of nozzles, not shown, communicating with this common liquid chamber, and heaters, not shown, formed in the respective nozzles and each serving as a discharge energy generation means. The ink supplied from the sub-tank 3 and contacting with each heater undergoes a state change following a sudden volume change (generation of bubbles) when an electric energy is input to each heater. By an acting force based on this ink state change, the ink is discharged from the discharge port, not shown, communicating with each nozzle. The ink jet recording element 38 forms an image on a recording target material while being scanned forward and backward along the guide shaft 8.

The cap member 35 and the cover member 34 are provided on the upper surface of the sub-tank 3. An air hole 15 is formed in a cap side surface 365*a* of the cap member 35 so as to communicate an interior of the sub-tank 3 with the air and a communication section 39 is formed on a cap lower surface 35*b* side of the cap member 35. A gas-liquid separation member 33 is arranged on the cap lower surface 35*b* so as to close the communication section 39. The gas-liquid separation member 33 is a porous member made of PTFE (polytetrafluoroethylene) or the like which transmits a gas but which shuts off a liquid such as the ink. This gas-liquid separation member 33 separates the gas from the liquid in the sub-tank 3.

The cover member 34 is attached to the cap member 35, thereby forming a communication path 40 that connects the air hole 15 to the communication section 39.

An area which stores the ink of the sub-tank 3 includes an area which stores the ink absorbing member 37 which can be impregnated with and hold the ink and a space V2 which is formed between the ink absorbing member 37 and a first side surface 36*a* of the ink reservoir 36, in which the ink absorbing member 37 is not arranged, and which can temporarily store a raw ink. The ink absorbing member 37 is a porous member made of polyurethane, polypropylene or the like.

In this embodiment, the volume of the space V2 formed between the ink absorbing member 37 and the first side surface 36*a* of the ink reservoir 36 is set at 0.021 cc equal to an ink amount by which the ink is discharged from the discharge port, not shown, during a discharge operation right after ink replenishment, and a volume of the ink reservoir filled with the ink is set at 0.12 cc.

Figure 3:
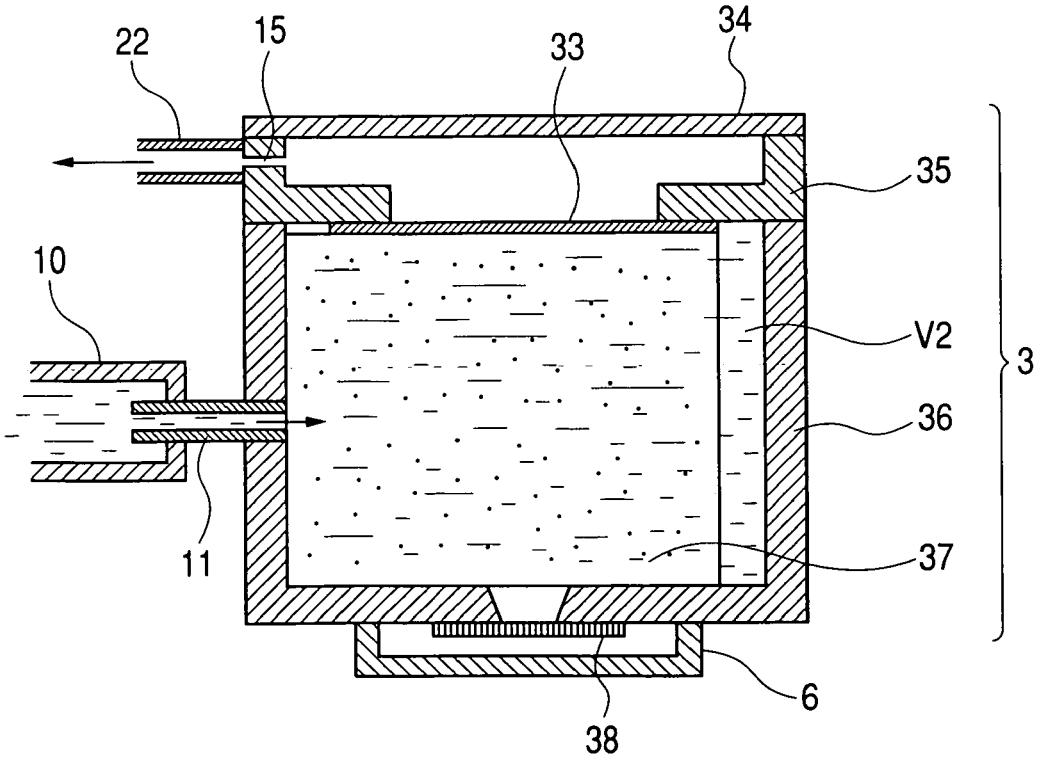
FIG. 3 is a side cross-sectional view of the ink jet recording head shown in FIG. 2 in a state in which an ink is fully filled into a sub-tank.
Figure 4:
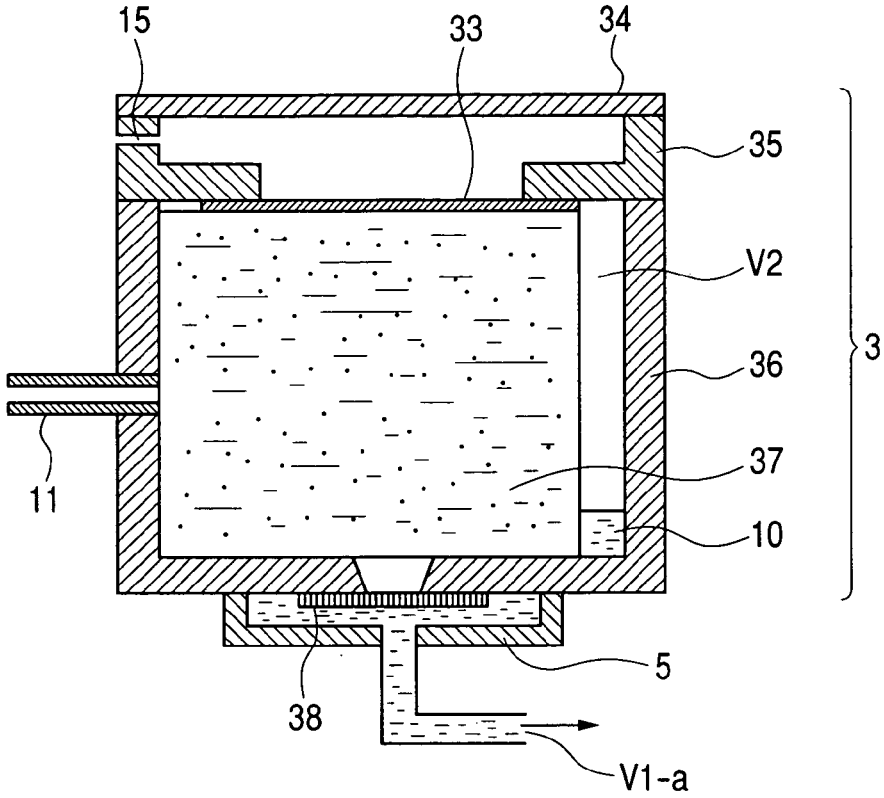
FIG. 4 is a side cross-sectional view of the ink jet recording head shown in FIG. 2 in a state in which an absorbing cap is connected to an ink jet recording element and the ink is absorbed.
Figure 5:
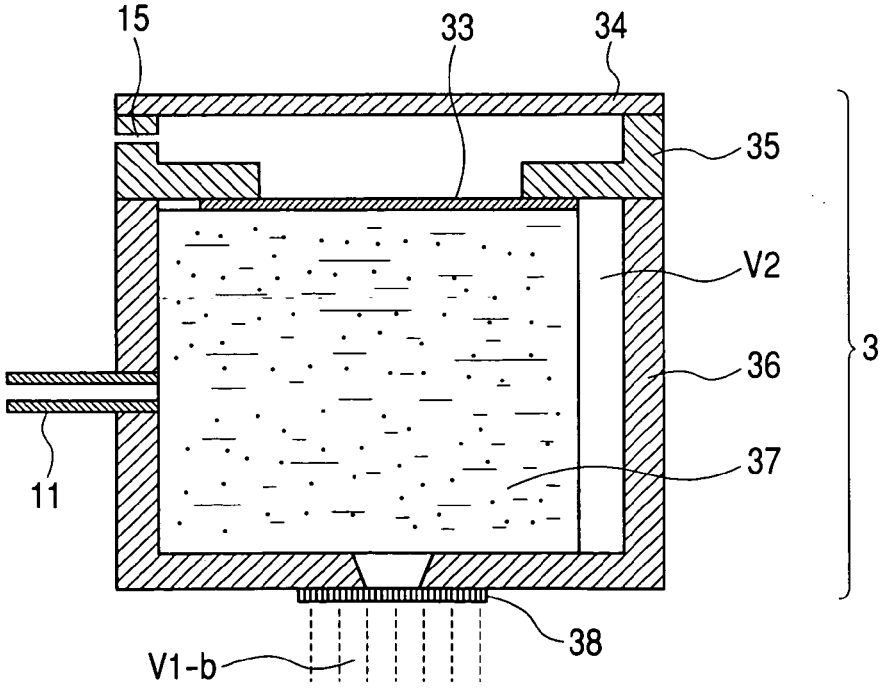
FIG. 5 is a side cross-sectional view of the ink jet recording head shown in FIG. 2 in a state in which pre-discharge is carried out.

Next, a recovery operation of the ink jet recording head in the ink jet recording apparatus in Embodiment 1 will be described with reference to FIGS. 3 to 5.

Before and right after a recording apparatus main body is turned on, the ink jet recording head 1 waits at the home position 23.

If a recording signal is transmitted to the recording apparatus main body, then the dummy cap 6 seals the discharge port of the ink jet recording element 38 and the supply port 10 of the main tank 4 is connected to the ink supply port 11 of the sub-tank 3. The air intake cap 22 is connected to the air hole 15 of the sub-tank 3, the negative pressure generator 7 absorbs the air in the sub-tank 3 by a fixed amount of 0.15 cc, and the air in the ink reservoir 36 is discharged from the air hole 15 through the gas-liquid separation member 33. Accordingly, the internal pressure of the sub-tank 3 is reduced and the ink is supplied into the ink reservoir 36 from the main tank 4 through the supply tube 10 and the ink supply port 11. An absorption amount of the negative pressure generator 7 is larger than the internal volume of the ink reservoir 36 of 0.12 cc. Therefore, the ink is fully filled into the ink reservoir 36 until the ink contacts with the gas-liquid separation member 33 irrespective of an ink residual amount in the ink reservoir 36 (see FIG. 3).

A recovery operation is performed so as to prevent a backward flow of the ink in the nozzle toward the sub-tank 3 which flow occurs when the internal pressure of the sub-tank 3 is reduced or prevent poor discharge caused by clogging of the ink which viscosity is improved after the ink is left as it is for a long time. In this recovery operation, the air hole 15 of the sub-tank 3 and the ink supply port 11 are opened, the absorbing cap 5 is connected to the ink jet recording element 38, and the negative pressure generator 7 is activated by a fixed amount to absorb the ink in the nozzle by V1-*a* (0.02 cc) (See FIG. 4).

Further, a wiping device, not shown, wipes away the ink adhering to the discharge port surface of the ink jet recording element 38 by wiping after the ink is absorbed. Further, the ink is discharged by an initial pre-discharge amount V1-*b* (0.001 cc) by pre-discharge so as to eliminate a mixture color ink forced into the nozzle by this piping (see FIG. 5).

After the recovery operation and the pre-discharge are finished, a recording operation is started. At the start of recording, there is no ink that is not absorbed by the ink absorbing member 37 or so-called raw ink (a raw ink section 90 shown in FIG. 4). Therefore, an appropriate negative pressure can be generated. In addition, a series of the recovery operation and the pre-discharge are performed right after ink filling. Therefore, the time for which the raw ink section 90 that is not held by the ink absorbing member 37 is present is extremely short and ink leakage can be prevented while recording is not performed.

Figure 10:
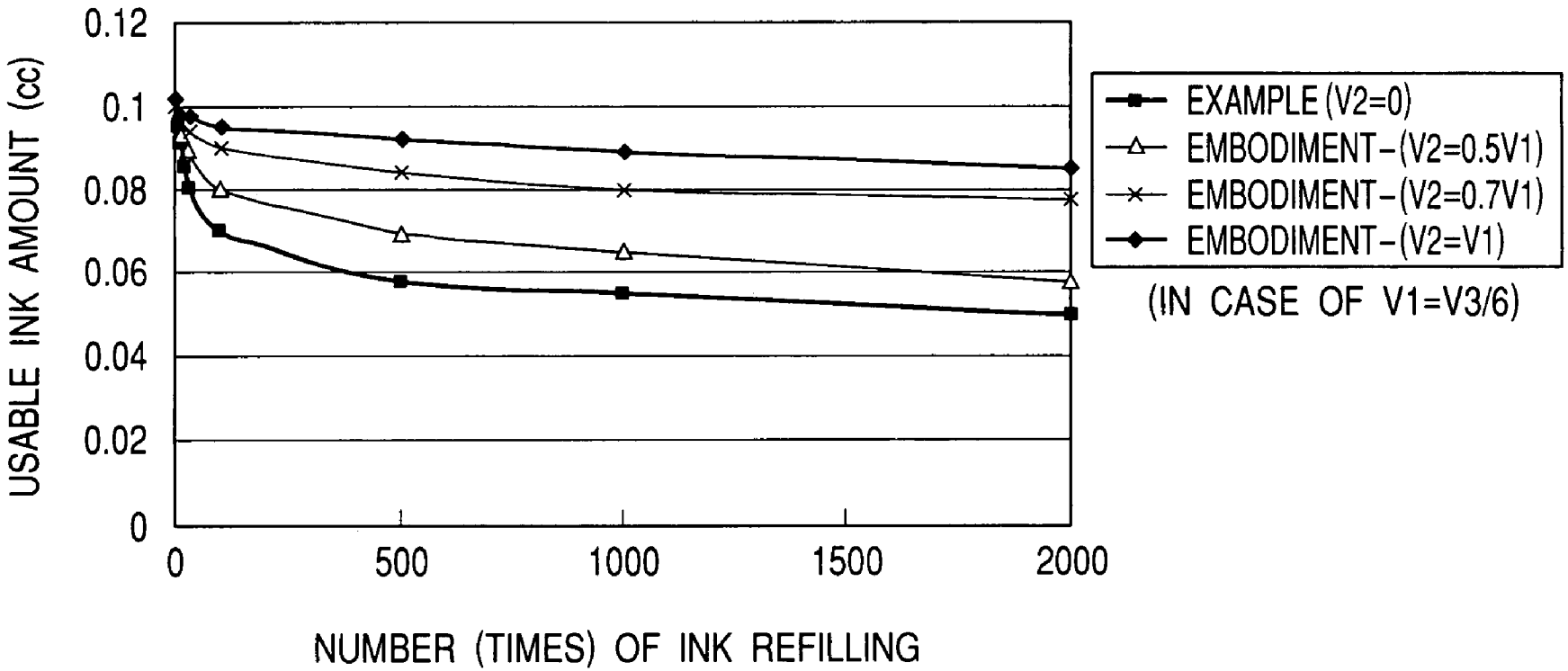
FIG. 10 is a graph which illustrates changes in the usable ink amounts relative to the number of times of ink refilling in the embodiments of the present invention and in a comparison example.
Figure 11:
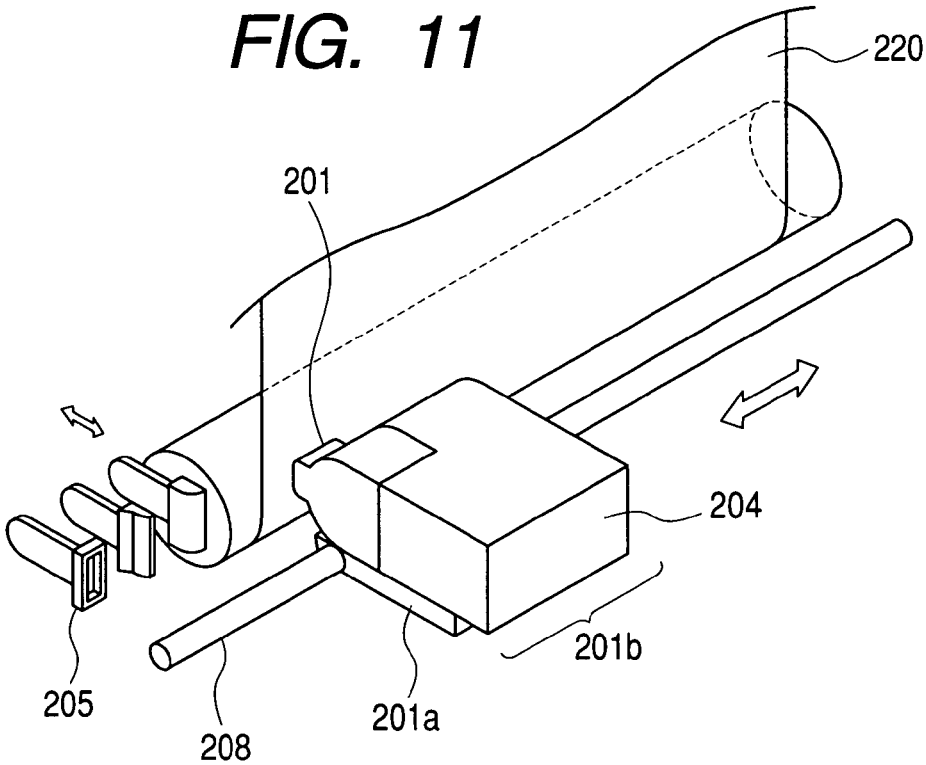
FIG. 11 is a partial schematic perspective view which illustrates one example of a conventional on-carriage type ink jet recording apparatus employing a head cartridge.
Figure 12:
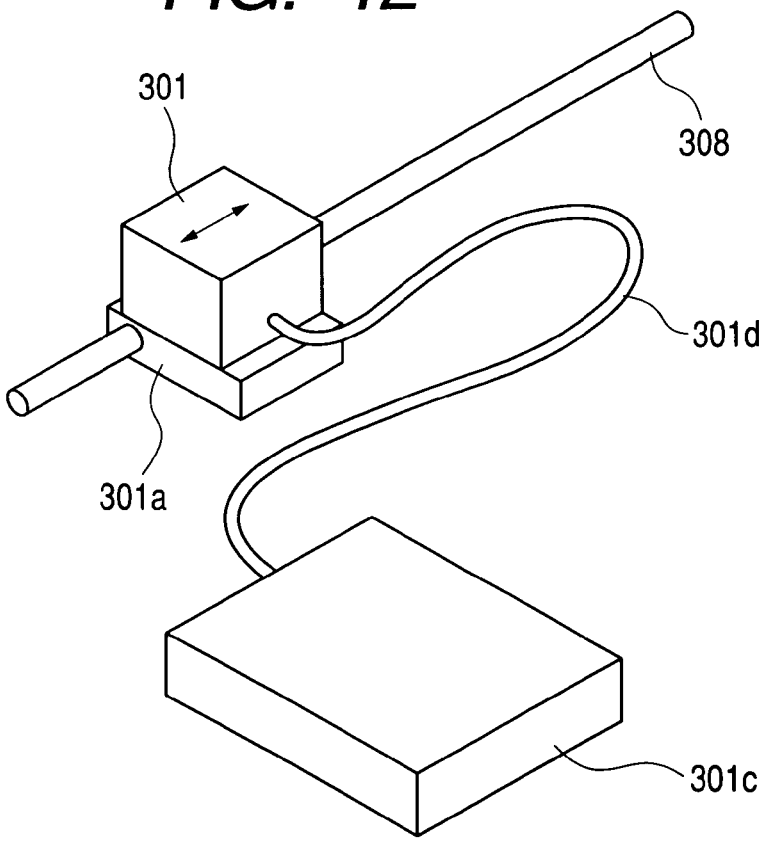
FIG. 12 is a partial schematic perspective view which illustrates one example of a conventional tube-supply type ink jet recording apparatus employing a tank cartridge.
Figure 13:
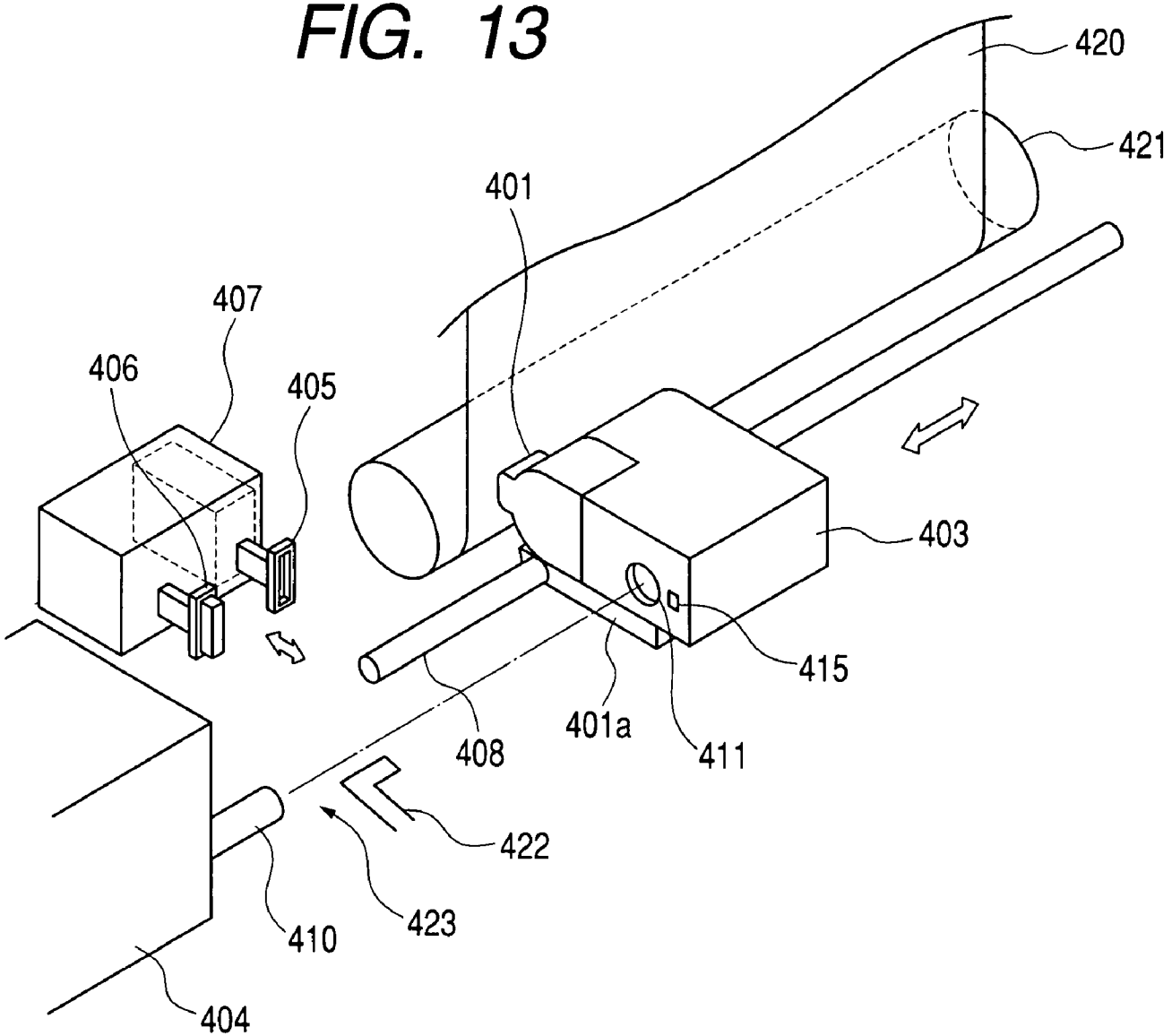
FIG. 13 is a partial schematic perspective view which illustrates one example of a conventional pit-in type ink jet recording apparatus.
Figure 14:
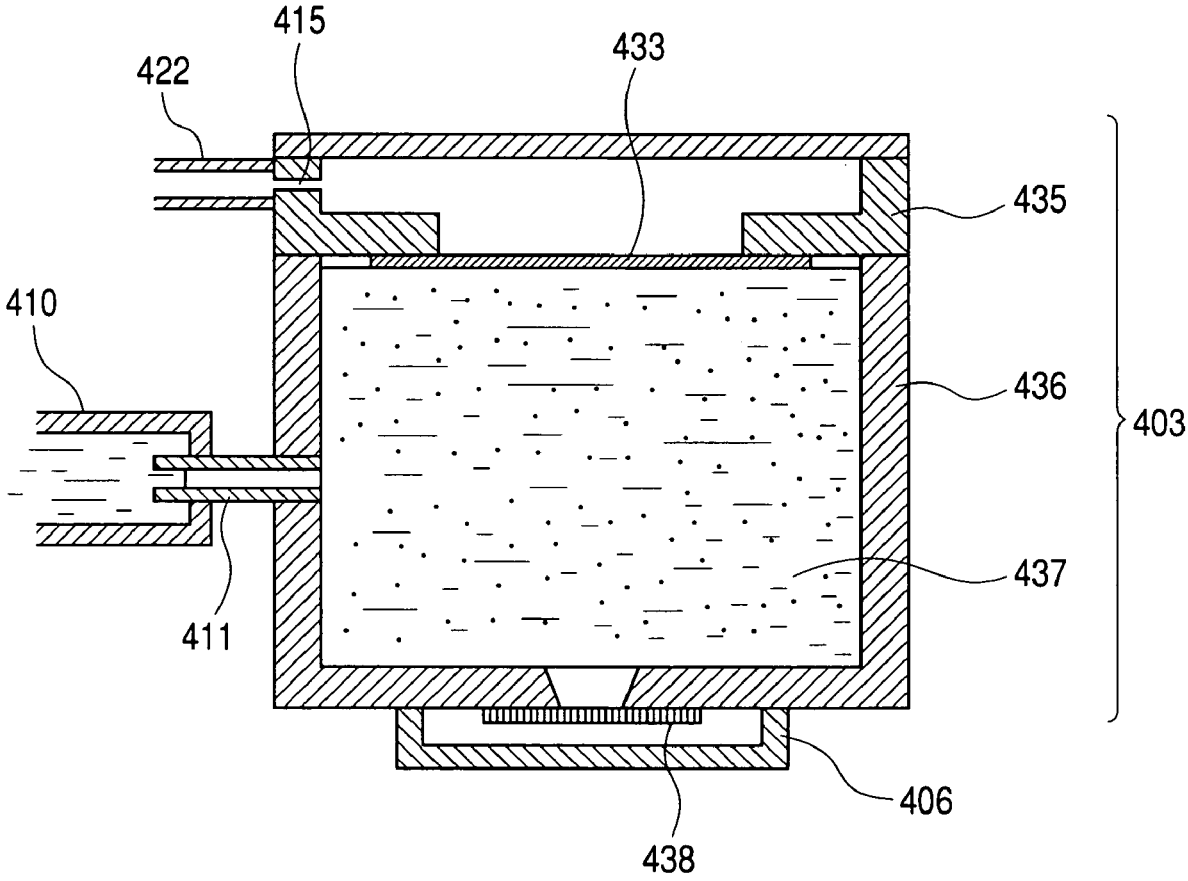
FIG. 14 is a side cross-sectional view which illustrates one example of a conventional pit-in type ink jet recording head.
Figures 15A, 15B, 15C:
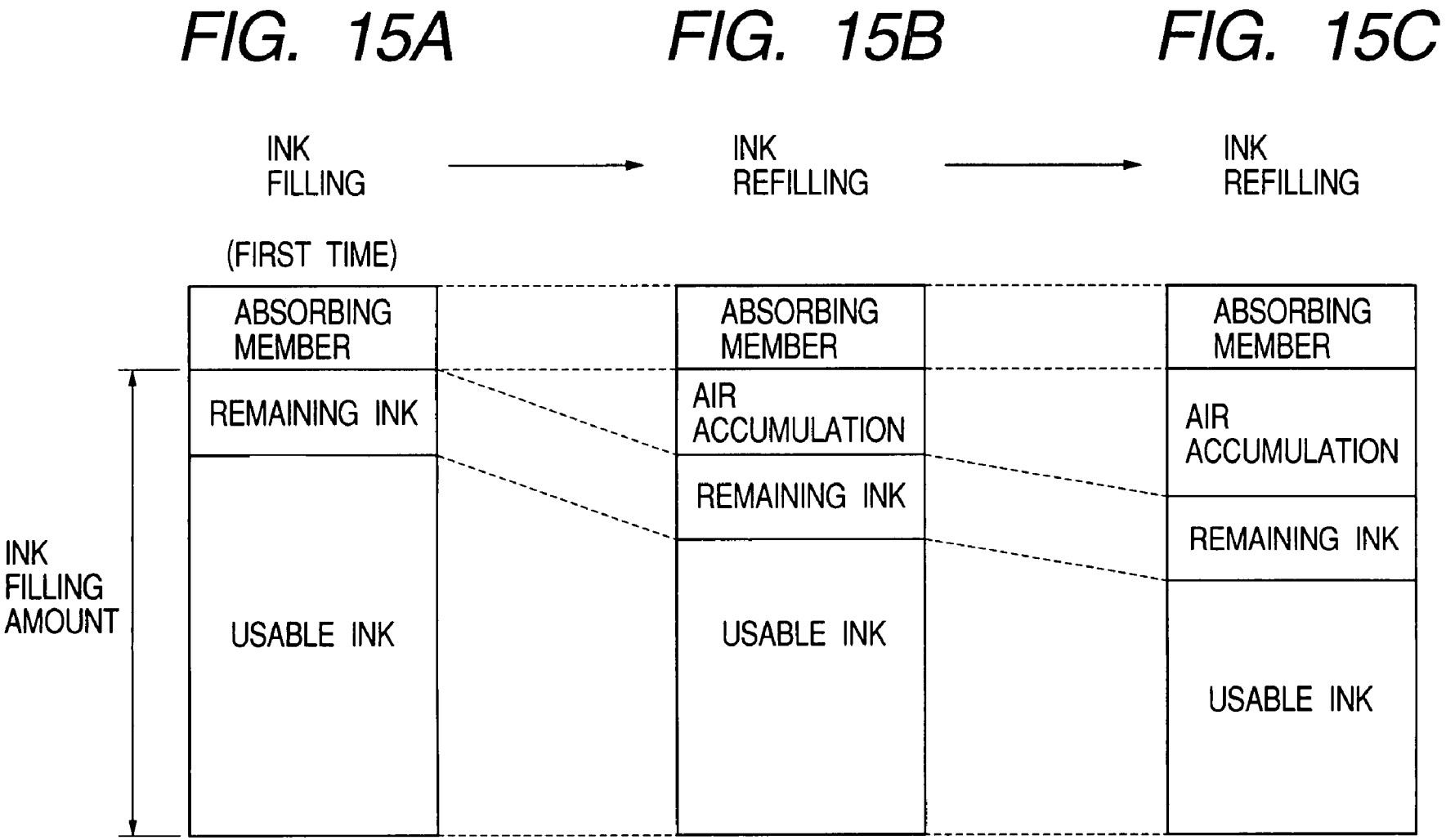
FIGS. 15A, 15B, and 15C are typical views which typically illustrate the transition of the usable ink amount of the conventional pit-in type ink jet recording head according to refilling of the ink.

The values mentioned above are given for illustrative purposes and the present invention is not limited thereto. Specifically, the values satisfy the following conditions. If the internal volume of the sub-tank 3 which stores the ink right after the supply of the ink is V3, the space in which the ink absorbing member 37 is not arranged is V2, a sum of the amount V1-*a* (0.02 cc) by which the ink is discharged from the discharge port in one recovery operation and the initial pre-discharge amount V1-*b* (0.001 cc) is V1, V2=V1 and V3=6V1 are satisfied. It only suffices that the total ink amount is equal to or smaller than the total ink amount V1 by which the ink is discharged from the discharge port in a series of discharge operations performed right after ink filling and that the space V2 in which the ink absorbing member is not arranged is secured. Usable ink amounts (each consisting of a recovery ink amount+a pre-discharge ink amount+a recording ink amount) when recording and ink refilling are performed 2,000 times while changing the volume of the space V2 of the ink jet recording head in which the ink absorbing member is not arranged in Embodiment 1 to V2=V1, V2=0.7V1, V2=0.5V1, and V2=0 (conventional art), respectively are measured. FIG. 10 illustrates measurement results.

Figure 17:
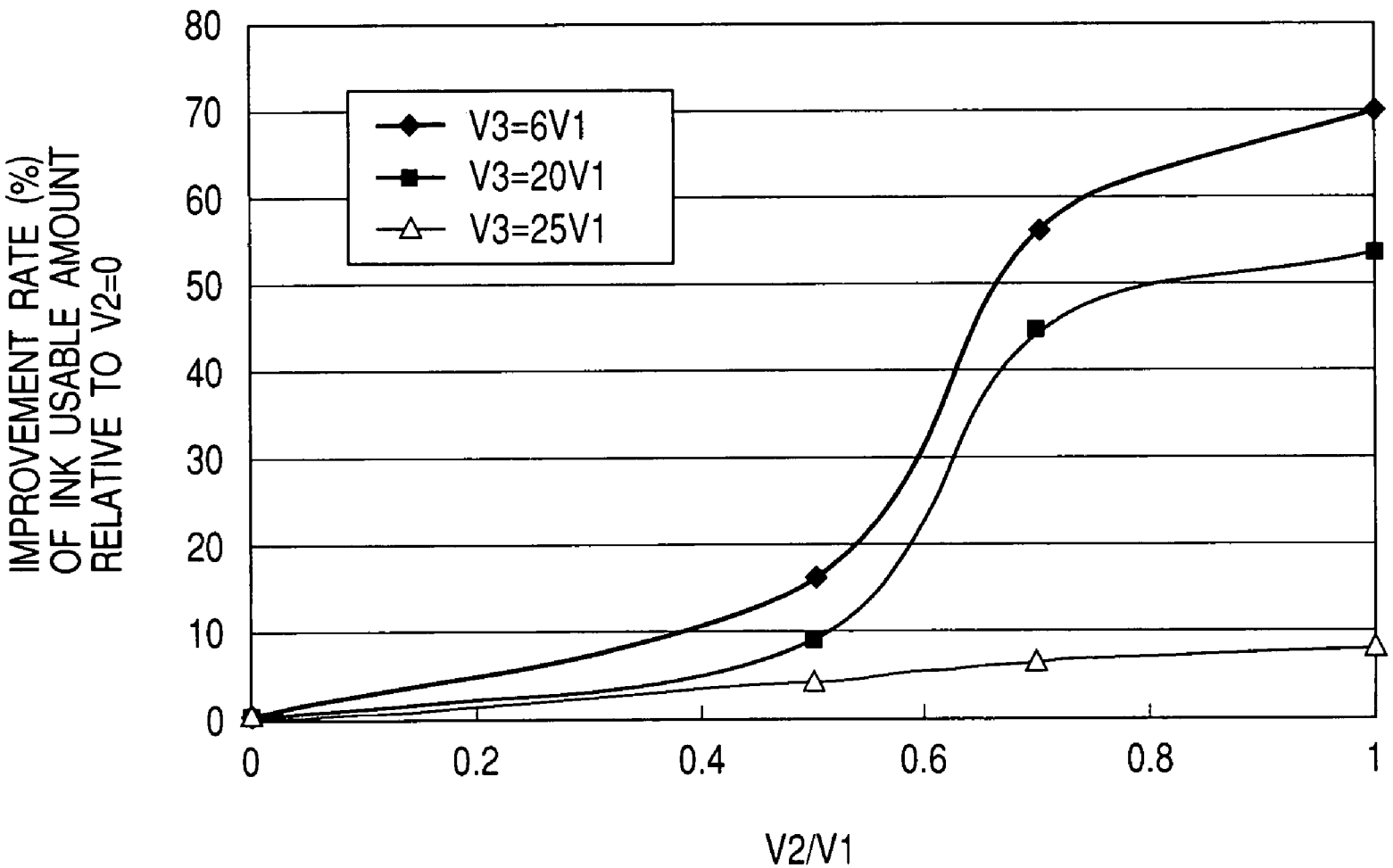
FIG. 17 is a graph which illustrates the improvement rates relative to V2=0.

As can be seen from the graph of FIG. 10, the usable ink amount of the conventional art when performing ink refilling 2,000 times increases by about 0.008 cc (the improvement rate of the ink utilization efficiency is about 16%) at V2=0.5V1. By contrast, at V2=0.7V1 and V2=V1, the usable ink amounts increase by 0.028 cc and 0.035(the improvement rates are about 56% and 70%), respectively. Thus, if V2 is equal to or larger than 0.71 V1, the ink utilization efficiency considerably improves. They are measurement results by changing the volume of V2 so as to have a relationship of V3= 6V1. The same experiment is conducted by further changing V2 to have V3=20V1 and V3=25V1, i.e., in a case where the volume ratio of V3 to V2 is far higher. FIG. 16 illustrates respective parameters as well as ink usable amounts after performing ink refilling 2,000 times and improvement rates of the ink usable amounts for the respective parameters relative to V2=0. FIG. 17 is a graph which illustrates the improvement rates relative to V2=0 improvement rates. As can be seen from the graph of FIG. 17, at V3=20V1, the ink utilization efficiency greatly improves if V2 and V1 satisfy V2/V1≧0.7. At V3=20V1, even if V2 is set a maximum (V2=V1), the ink utilization efficiency improves only by about 8%. This demonstrates that the effect of the invention is quite low. Based on these results, it is appropriate to set the relationship among the total ink amount V1 by which the ink is discharged from the discharge port in the ink discharge operation right after ink filling, the volume of the space V2 in which the ink absorbing member 37 is not arranged, and the internal volume V3 of the sub-tank 3 which stores the ink right after the supply of the ink to satisfy V3≦20V1 and 0.7V1≦V2≦V1.

Figure 6:
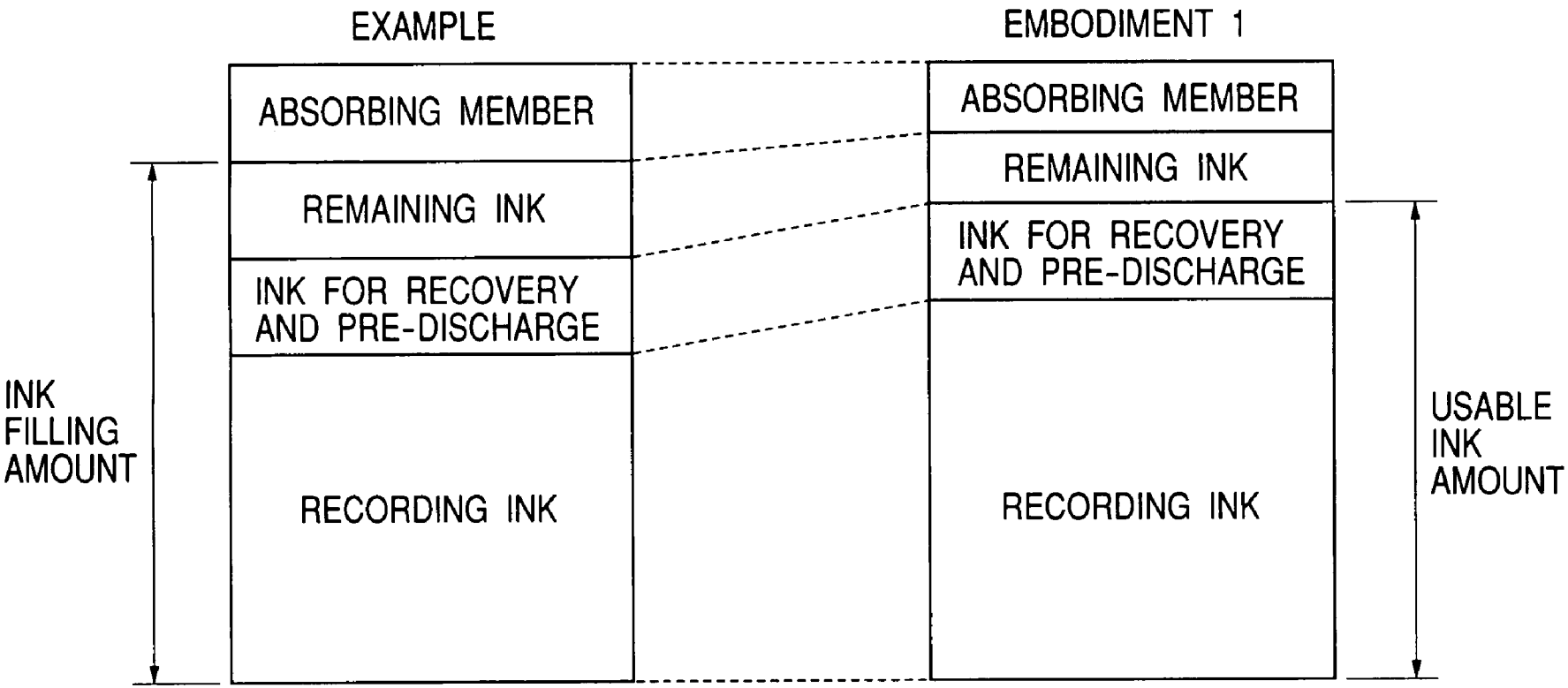
FIG. 6 is a typical view which typically compares an ink filling amount and a usable ink amount of the ink jet recording head in Embodiment 1 according to the present invention and those of a conventional ink jet recording head during initial filling.

In Embodiment 1, as shown in FIG. 6, by forming the space V2, the occupation ratio of the ink absorbing member 37 in the ink reservoir 36 is decreased. Accordingly, as compared with the ink jet recording head (conventional art shown in FIG. 6) in which the ink absorbing member is arranged in the ink reservoir almost entirely, it is possible to increase the ink filling amount and reduce the residual ink that remains in the ink absorbing member without being used after recording.

Figure 7:
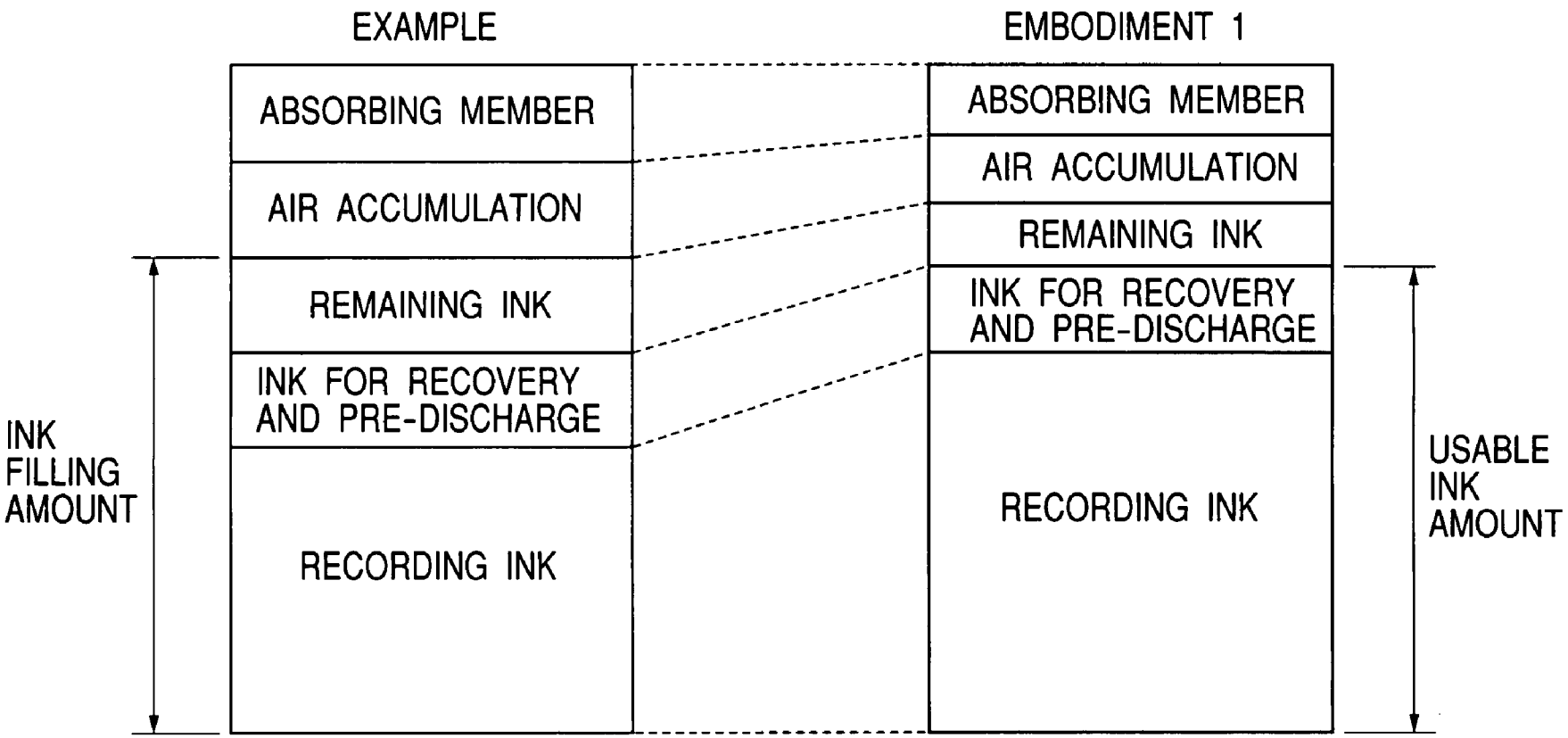
FIG. 7 is a typical view which typically compares an ink filling amount and a usable ink amount of the ink jet recording head in Embodiment 1 according to the present invention with those of the conventional ink jet recording head when the ink is refilled 30 times.

As shown in FIG. 7, it is also possible to reduce the air accumulation during ink refilling (in a state in which ink refilling is performed 30 times in FIG. 7).

As can be understood, the configuration of the sub-tank in the ink jet recording apparatus in Embodiment 1 can greatly improve the ink utilization efficiency relative to the ink jet recording head having a small ink capacity as employed in the pit-in type apparatus.

Furthermore, by slightly processing the ink filling member under these conditions, the ink utilization efficiency is improved. Therefore, cost is hardly pushed up.

(Embodiment 2)

Figure 8A:
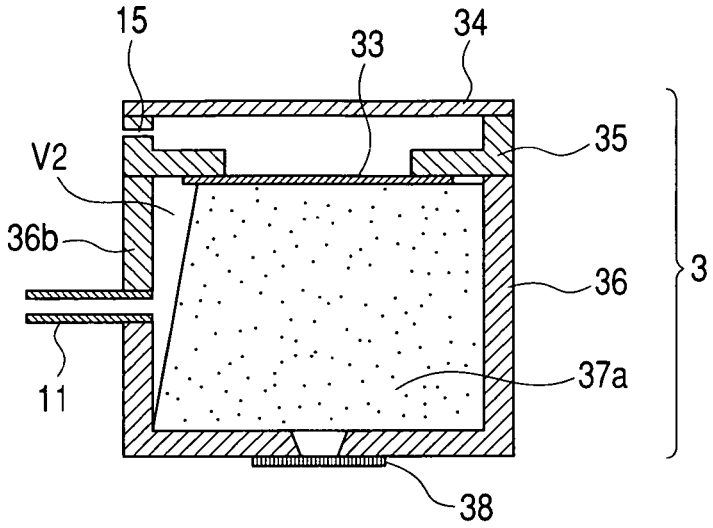
FIGS. 8A, 8B, and 8C are side cross-sectional views of an ink jet recording head employing a gas-liquid separation member in Embodiment 2 according to the present invention.
Figure 8B:
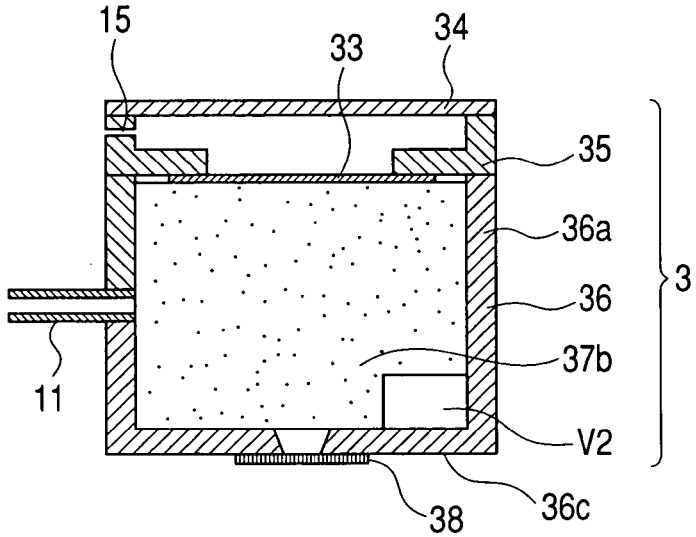
Figure 8C:
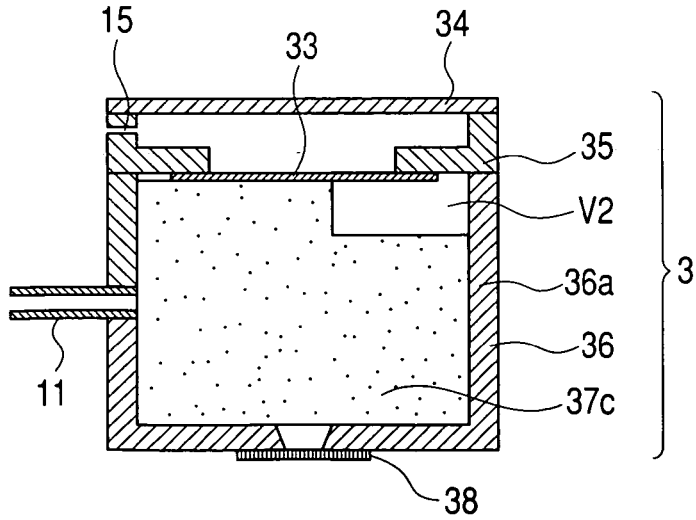

FIGS. 8A to 8C are side cross-sectional views of the ink jet recording head, illustrating examples of the ink absorbing member applied to the sub-tank in the ink jet recording head according to the present invention. The ink jet recording head in Embodiment 2 is equal in configuration as the ink jet recording head in Embodiment 1 except for the difference in the shape of the ink absorbing member. Therefore, the configuration of the ink jet recording head will not be described herein in detail and the same constituent members as those in Embodiment 1 are denoted by the same reference symbols, respectively.

An ink absorbing member 37*a* shown in FIG. 8A is shaped so that a second side surface 36*b* of the ink absorbing member 37*a* is cut aslant so as to form the space V2, in which the ink absorbing member 37*a* is not arranged, on a second side surface 36*b* on which the ink supply port 11 is provided.

An ink absorbing member 37*b* shown in FIG. 8B is shaped so that a lower right corner of the ink absorbing member 37*b* is cut off so as to form the space V2, in which the ink absorbing member 37*a* is not arranged, in a corner of the ink reservoir 36 formed by the first side surface 36*a* and a bottom 36*c*.

An ink absorbing member 37*c* shown in FIG. 8C is shaped so that an upper right corner of the ink absorbing member 37*c* is cut off so as to form the space V2, in which the ink absorbing member 37*a* is not arranged, in a corner of the ink reservoir 36 formed by the first side surface 36*a* and the gas-liquid separation member 33.

As shown in this embodiment, the ink absorbing member may be formed so that the space V2 arranged in the ink reservoir is the space closed by the ink absorbing member 37 and inner walls of the ink reservoir 36, the space closed by the ink absorbing member 37 and the gas-liquid separation member, or the space closed by the ink absorbing member 37, the inner walls of the ink reservoir 36, and the gas-liquid separation member 33. However, the shape of the ink absorbing member is not limited to these examples. As long as the ink absorbing member 37 contacts with the communication port to the discharge port so as to generate a negative pressure at the discharge port, the ink absorbing member can be formed arbitrarily. In Embodiment 2 similarly to Embodiment 1, it is appropriate to set the relationship among the total ink amount V1 by which the ink is discharged from the discharge port in the ink discharge operation right after ink filling, the volume of the space V2 in which the ink absorbing member 37 is not arranged, and the internal volume V3 of the sub-tank 3 which stores the ink right after the supply of the ink to satisfy $V3 \leqq 20V1$ and $0.7V1 \leqq V2 \leqq V1$.

(Embodiment 3)

Figure 9:
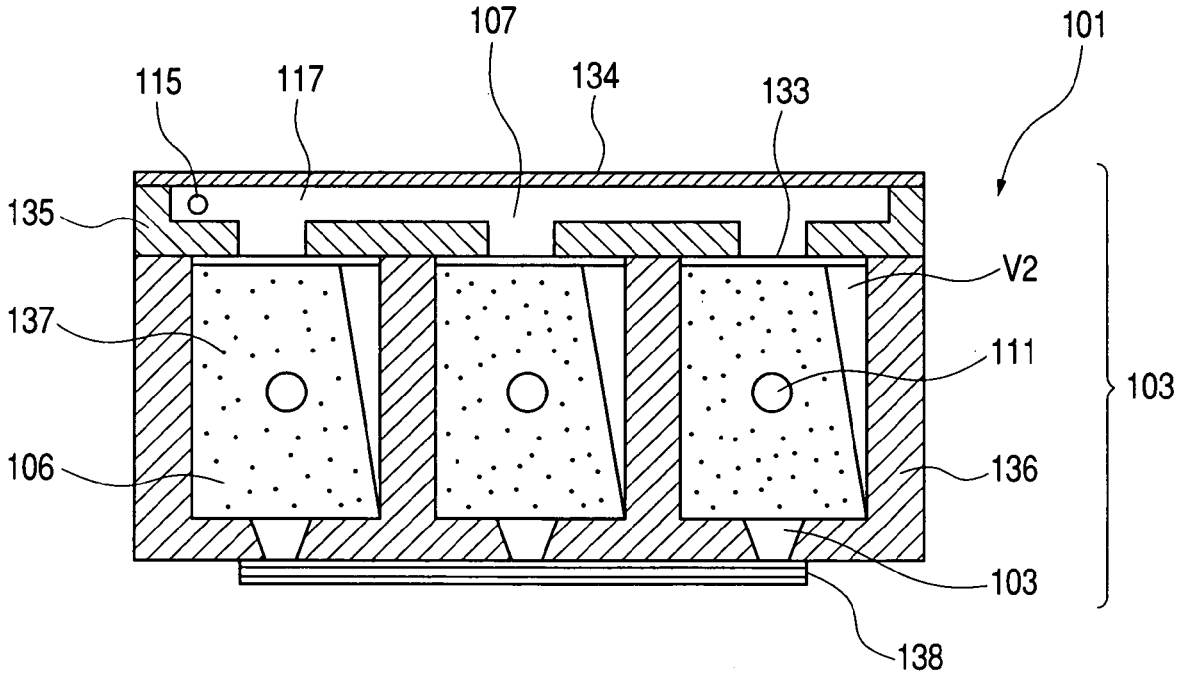
FIG. 9 is a side cross-sectional view of an ink jet recording head employing a gas-liquid separation member in Embodiment 3 according to the present invention.

FIG. 9 is a side cross sectional view of an ink jet recording head in Embodiment 3.

A sub-tank 103 of the ink jet recording head 101 in this embodiment is constituted so that an interior of an ink reservoir 136 is divided into three ink chambers 106, an ink supply section 103 is provided below each of the ink chambers 106, and that an ink absorbing member 137 stored in each ink chamber 106 is supplied to an ink jet recording element 138.

A cap member 135 and a cover member 134 are attached onto the ink reservoir 136. Communication sections 107 corresponding to the respective ink chambers 116 and an air hole 115 which communicates the interiors of the ink chambers 116 with the air are formed in the cap member 135. The cover member 134 is attached to the cap member 135, thereby forming a common communication path 117 which communicates the air hole 115 with the respective communication sections 107.

Each ink chamber 106 includes the ink absorbing member 137 large enough to form the space V2 therein and an ink supply port 111 communicating with an interior of each ink chamber 106 is formed to correspond to each ink chamber 106.

In this embodiment, the ink chamber 137 shaped so as to form the space V2, in which the ink absorbing member 137 is arranged, in a space closed by inner walls of the ink reservoir 136 and a gas-liquid separation member 133 is employed by way of example. However, the shape of the ink absorbing member 137 is not limited to this example but those described in Embodiment 1 and Embodiment 2 are also applicable. Further, it is appropriate to set the relationship among the total ink amount V1 by which the ink is discharged from the discharge port in the ink discharge operation right after ink filling, the volume of the space V2 in which the ink absorbing member 37 is not arranged, and the internal volume V3 of the sub-tank 103 which stores the ink right after the supply of the ink to satisfy $V3 \leqq 20V1$ and $0.7V1 \leqq V2 \leqq V1$.

The embodiments of the ink jet recording apparatus according to the present invention have been described so far in detail. However, the present invention is not limited to these embodiments but the present invention may cover the following other appropriate embodiments.

An ink jet recording apparatus according to Embodiment 1, wherein the ink discharge amount V1 is a sum of an amount of the ink discharged from the ink discharge port in an absorbing operation of the negative pressure generator and an amount of the ink pre-discharged from the ink discharge port.

An ink jet recording apparatus, wherein the absorbing member non-arrangement area consists of a space closed by the ink absorbing member and inner walls of the sub-tank.

An ink jet recording apparatus, wherein the absorbing member non-arrangement area consists of a space closed by the ink absorbing member and the gas-liquid separation member.

An ink jet recording apparatus, wherein the absorbing member non-arrangement area consists of a space closed by the ink absorbing member, inner walls of the sub-tank, and the gas-liquid separation member.

As described so far, the area in the sub-tank which stores the ink is constituted to include the absorbing member arrangement area in which the ink absorbing member is arranged and the absorbing member non-arrangement area in which the ink absorbing member is not arranged. That is, it is possible to reduce the ink amount remaining in the ink absorbing member without being used by as much as the reduced amount of the ink absorbing member. It is also possible to reduce the air accumulation in the ink absorbing member which is generated during ink refilling by reducing the amount of the ink absorbing member. Therefore, the ink filling amount in the sub-tank can be increased, so that the usable ink amount can be increased without making the sub-tank large in size. Furthermore, it is appropriate to set the relationship among the total ink amount V1 by which the ink is discharged from the discharge port in the ink discharge operation right after ink filling, the volume of the space V2 in which the ink absorbing member 37 is not arranged, and the internal volume V3 of the sub-tank 3 which stores the ink right after the supply of the ink to satisfy V3≦20V1 and 0.7V1≦V2≦V1. By so setting, the ink which is not impregnated into and held by the ink absorbing member or so-called raw ink is promptly discharged in the ink discharge operation right after ink filling. Therefore, it is possible to maintain an appropriate negative pressure against the ink discharge port at need and prevent poor discharge during recording and the leakage of the ink from the ink discharge port while recording is not performed. Accordingly, the ink jet recording apparatus smaller in size, higher in reliability, and lower in cost can be provided.

What is claimed is:

1. An ink reservoir of an ink jet recording apparatus, the ink jet recording apparatus comprising: an ink jet head; the ink reservoir attached to the head and containing an ink absorbing member which stores an ink supplied to the head; pressure reduction means, connected to the ink reservoir at a specific timing, for reducing an internal pressure of the reservoir; and an ink tank containing the ink replenished into the ink reservoir by a pressure reduced state caused by the pressure reduction means connected to the ink reservoir at the specific timing, the ink jet recording apparatus discharging the ink from the ink jet head by a specified amount and performing an ink filling operation after the ink is replenished into the ink reservoir using the pressure reduction means and the ink tank, the ink reservoir comprising:

an absorbing member arrangement area in which the ink absorbing member is arranged; and an absorbing member non-arrangement area that is a space in which the ink absorbing member is not arranged and that temporarily stores the ink, wherein if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of V3≦20V1 and 0.7V1≦V2≦V1.

2. The ink reservoir according to claim 1, wherein the ink reservoir is spatially divided into a coupling section of the pressure reduction means and the absorbing member arrangement area by a gas-liquid separation member, the gas-liquid separation member restricting filling of the ink into the ink reservoir.

3. An ink jet head structure comprising an ink reservoir of an ink jet recording apparatus, the ink jet recording apparatus comprising: an ink jet head; the ink reservoir attached to the head and containing an ink absorbing member which stores an ink supplied to the head; pressure reduction means, connected to the ink reservoir at a specific timing, for reducing an internal pressure of the reservoir; and an ink tank containing the ink replenished into the ink reservoir by a pressure reduced state caused by the pressure reduction means connected to the ink reservoir at the specific timing, the ink jet recording apparatus discharging the ink from the ink jet head by a specified amount and performing an ink filling operation after the ink is replenished into the ink reservoir using the pressure reduction means and the ink tank, the ink jet head structure comprising:

an absorbing member arrangement area in which the ink absorbing member of the ink reservoir is arranged; and an absorbing member non-arrangement area that is a space in which the ink absorbing member is not arranged and that temporarily stores the ink, wherein if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of V3≦20V1 and 0.7V1≦V2≦V1.

4. The ink jet head structure according to claim 3, the ink reservoir is spatially divided into a coupling section of the pressure reduction means and the absorbing member arrangement area by a gas-liquid separation member, the gas-liquid separation member restricting filling of the ink into the ink reservoir.

5. An ink jet recording apparatus comprising:

a main tank storing an ink;

a negative pressure generator generating a negative pressure; and an ink jet recording head having an ink discharge port for discharging the ink, the ink jet recording head comprising a sub-tank storing the ink supplied from the main tank, wherein the sub-tank contains therein an ink absorbing member impregnated with and holding the ink, and comprises: a gas-liquid separation member arranged in the sub-tank, and separating the ink stored in the sub-tank from external air; an air hole for discharging air in the sub-tank through the gas-liquid separation member; an ink filled section replenished with the ink, the negative pressure generator is connected to the air hole and discharges the air in the sub-tank, whereby the ink is supplied from the main tank into the sub-tank through the ink filled section and the ink is discharged from the ink discharge port by a specified amount right after the ink is supplied, an area in the sub-tank which stores the ink right after the ink is supplied includes an absorbing member arrangement area in which the ink absorbing member is arranged and an absorbing member non-arrangement area that is a space in which the ink absorbing member is not arranged and which temporarily stores the ink, and wherein if an ink discharge amount that is the specified amount by which the ink is discharged is V1, a volume of the absorbing member non-arrangement area is V2, and a volume of the area in the ink reservoir which stores the ink right after the ink is supplied is V3, then the volumes V1, V2, and V3 fall within ranges of V3≦20V1 and 0.7V1≦V2≦V1.

* * * * *